United States Patent [19]

Hamanishi et al.

[11] 4,327,569

[45] May 4, 1982

[54] TUBE FORMING MILL

[75] Inventors: Yoichi Hamanishi, Aichi; Akiteru Honma; Iwao Nihashi, both of Toyotashi; Seisuke Tanii, Okayama, all of Japan

[73] Assignees: Toyota Jidosha Kogyo Kabushiki Kaisha, Aichi; Kabushikikaisha Mori Tekkosho, Okayamaken, both of Japan

[21] Appl. No.: 135,901

[22] Filed: Mar. 31, 1980

[51] Int. Cl.[3] ..... B21B 31/08

[52] U.S. Cl. ..... 72/239

[58] Field of Search ..... 72/239, 238, 237, 226

[56] References Cited

U.S. PATENT DOCUMENTS 3,355,923 12/1967 Gillet ..... 72/239 X 3,376,724 4/1968 Wolfendale et al. ..... 72/239

*Primary Examiner*—Milton S. Mehr

*Attorney, Agent, or Firm*—Browdy & Neimark

[57] ABSTRACT

A tube forming mill, which consists of rolling mechanisms is mounted on movable trucks set or positioned on rails which are laid directionally crossing the material line flow at right angles thereto. The operation of the tube forming mill is as follows: While the rolling process is performed by one rolling mechanism, other rolling mechanism, which is to be used in the following process, is assembled onto the truck located at a position other than the unit rails which are on the material feeding line. After the last coil is passed through the rolling mechanism, the connector of the driving mechanism, which is disposed under the rails, is lowered to cut off the drive and the unit rails, together with the frame, are lifted by the elevating mechanism away from a fixing mechanism until the unit rails come up to the floor level. The truck, together with the rolling mechanism, is moved out of the rolling process line and the following truck, with a new rolling mechanism to be used in the next rolling process, is advanced to location of the unit rails. The new truck is made to rest on the fixing mechanism by reversing the above procedure; the connector is lifted to bring the vertical drive shaft of the rolling mechanism into engagement with the drive mechanism and thereby rotate the rolls to perform the next rolling process.

7 Claims, 7 Drawing Figures

TUBE FORMING MILL

BACKGROUND OF THE INVENTION

1. Field of the Invention

This invention relates to a multiple stage tube forming mill in which a plurality of rolling mechanisms are mounted on trucks. The trucks are set on rails, which are laid directionally crossing the material feeding line at right angles thereto. The rolling mechanisms are positioned on the material feeding line while rolling the coil material and are situated at other positions on the rails while the rolls are being set or adjusted or while the rolling mechanism stand by. More particularly, this invention relates to a tube forming mill in which a portion of the rails, that crosses the material feeding line, is formed as unit rails. These unit rails, together with a frame, can be moved vertically by operation of an elevating mechanism to set the truck on a fixing mechanism, in which the rollers can be assembled into or disassembled from the rolling mechanism, and in which the vertical drive shaft of the rolling mechanism can be brought into or out of engagement with the driving mechanism, which is disposed under the unit rails by lifting or lowering the connector arranged on the upper part of the driving mechanism.

2. Description of the Prior Art

As shown in FIG. 1, the conventional tube forming mill 1, which has been widely used is almost immovable once it has been positioned with respect to material feeding line. Therefore, in rolling the material into different shapes, it is a conventional practice to replace the rolls (not shown) which are mounted on rotating shafts 6. The shafts extend sideward, by means of universal joints, from bevel gear mechanism 4 which are connected in series to the motor 2 through the reduction gear 3. Alternatively, a whole stand, with several pairs of rolls is replaced.

During the replacement operation, the rolling process must be stopped. Furthermore, the conventional device is characterized several disadvantages in that that it requires skills of a high level and takes a substantial period of time to replace the rolls or the stand.

Moreover, the conventional devices, whether they be of the universal joint type as shown in FIG. 1, the link gear type or direct-couple type, are provided with a driving mechanism 8 located on the side of one roll stand 7, so that the device as a whole is large and occupies substantial floor space. This lowers the efficiency of the replacement and increases the cost thereof.

SUMMARY OF THE INVENTION

An object of this invention is to provide a tube forming mill which can overcome the above discussed drawbacks experienced with the conventional tube forming mill.

Another object of the invention is to provide a tube forming mill in which a plurality of trucks are set on rails, which are laid directionally crossing the material feeding line at right angles thereto. Rolling mechanisms, the rolls of which can be replaced or adjusted, are mounted on the trucks. The vertical drive shaft of the rolling mechanism can be brought into and out of engagement with the drive mechanism which is disposed under the rails through a connector.

DETAILED DESCRIPTION OF THE PREFERRED EMBODIMENT

Figure 1:
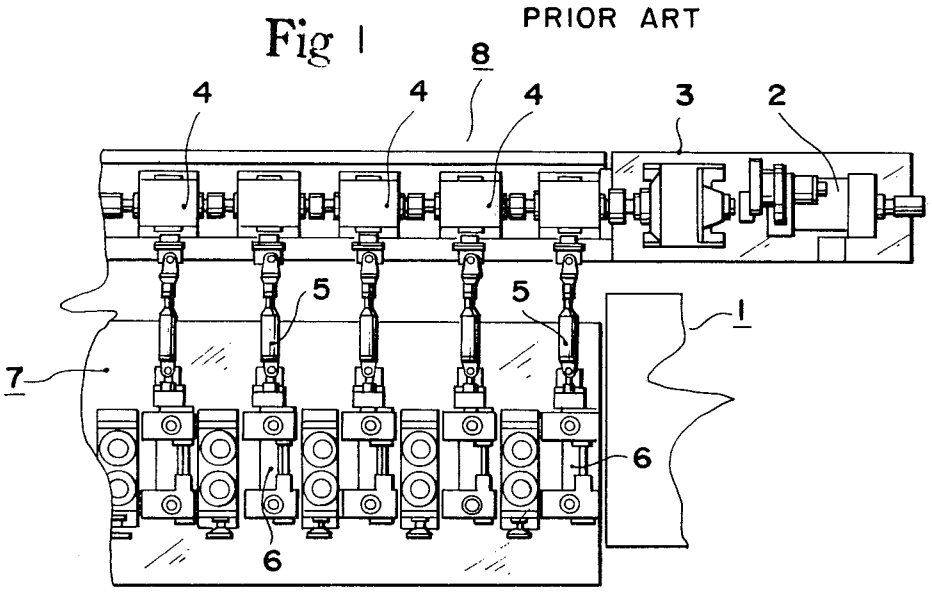
FIG. 1 is a partial plan view of a conventional tube forming mill known in the prior art.
Figure 2:
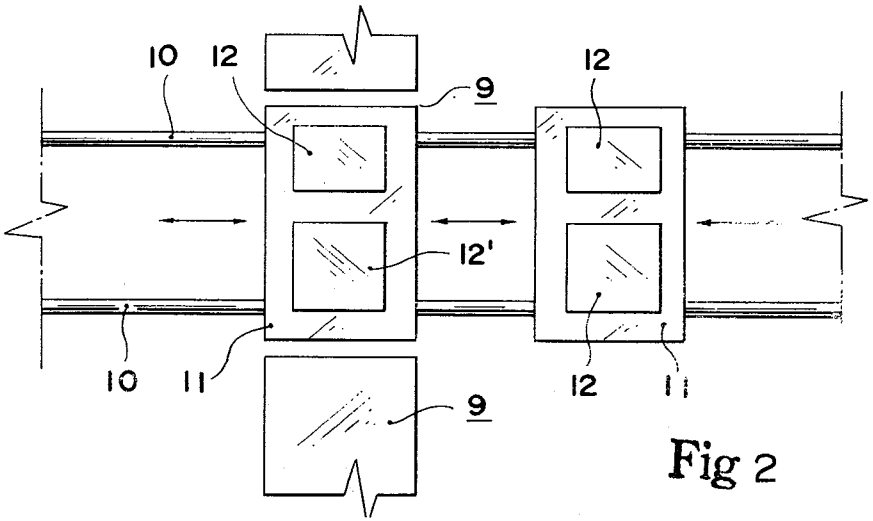
FIG. 2 is a schematic plan view of a tube forming mill of this invention.

In FIG. 2, reference numeral 9 indicates a rolling process line and 10 represents rails directionally crossing the material feeding line 9 at right angles thereto. While it is possible to lay a plurality of pairs of rails 10 crossing the line 9, only a single pair of rails are shown for the sake of simplicity.

Mounted on the rails 10 are a plurality of movable trucks 11, on which rolling mechanisms 12, 12' are detachably mounted. (The number of trucks may be more than two, but in this embodiment only two trucks are shown for the sake of simplicity.)

Figure 4:
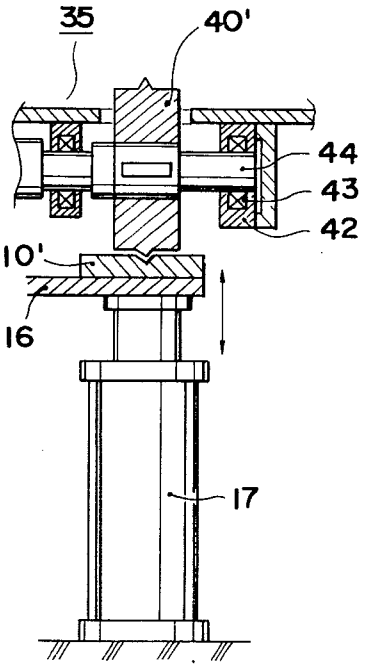
FIG. 4 is a partial cross-sectional view showing the vertical movement of unit rails.
Figure 3:
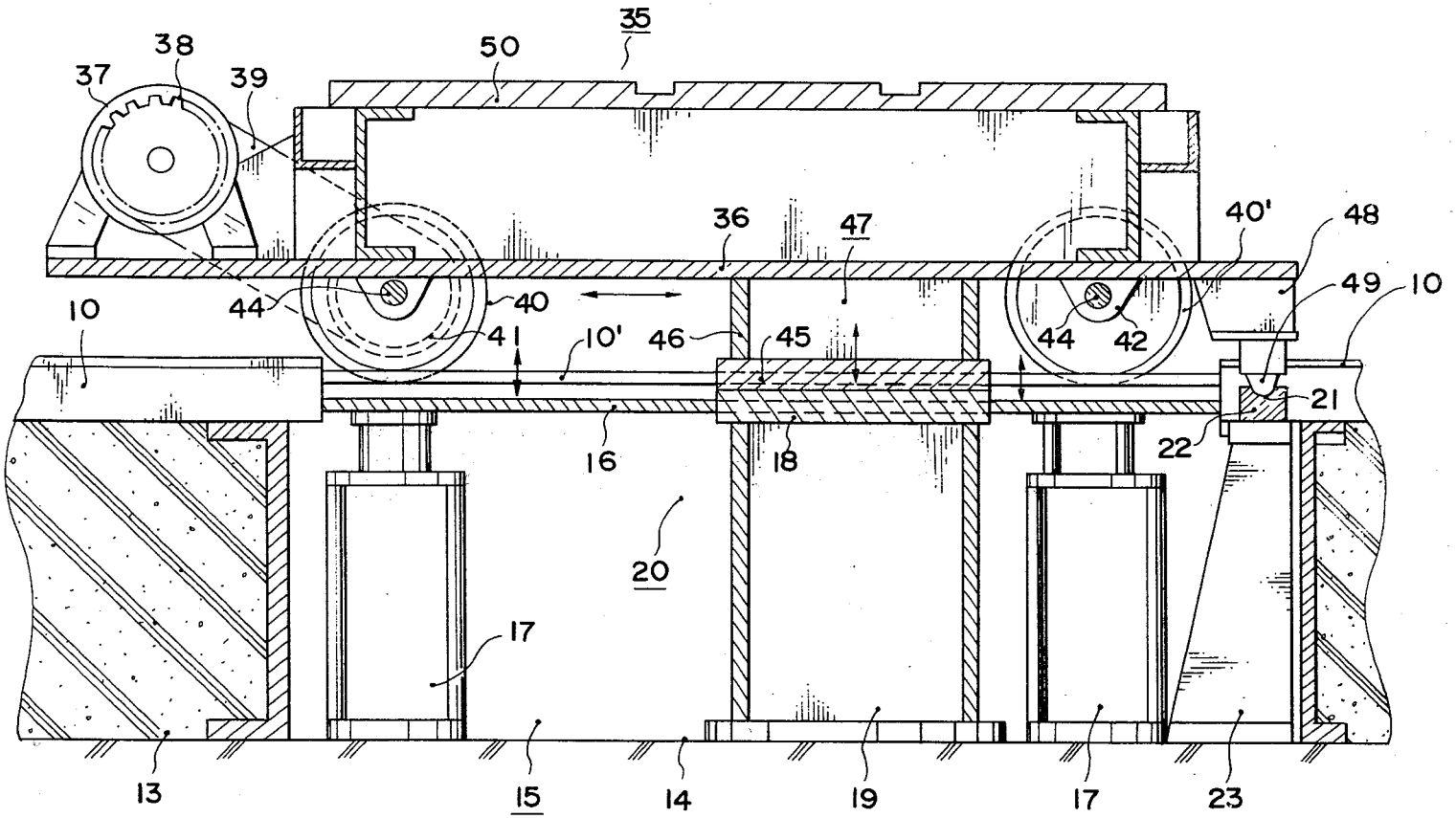
FIG. 3 is an elevational view of a movable truck and an elevating mechanism installed in the working area.
Figure 5:
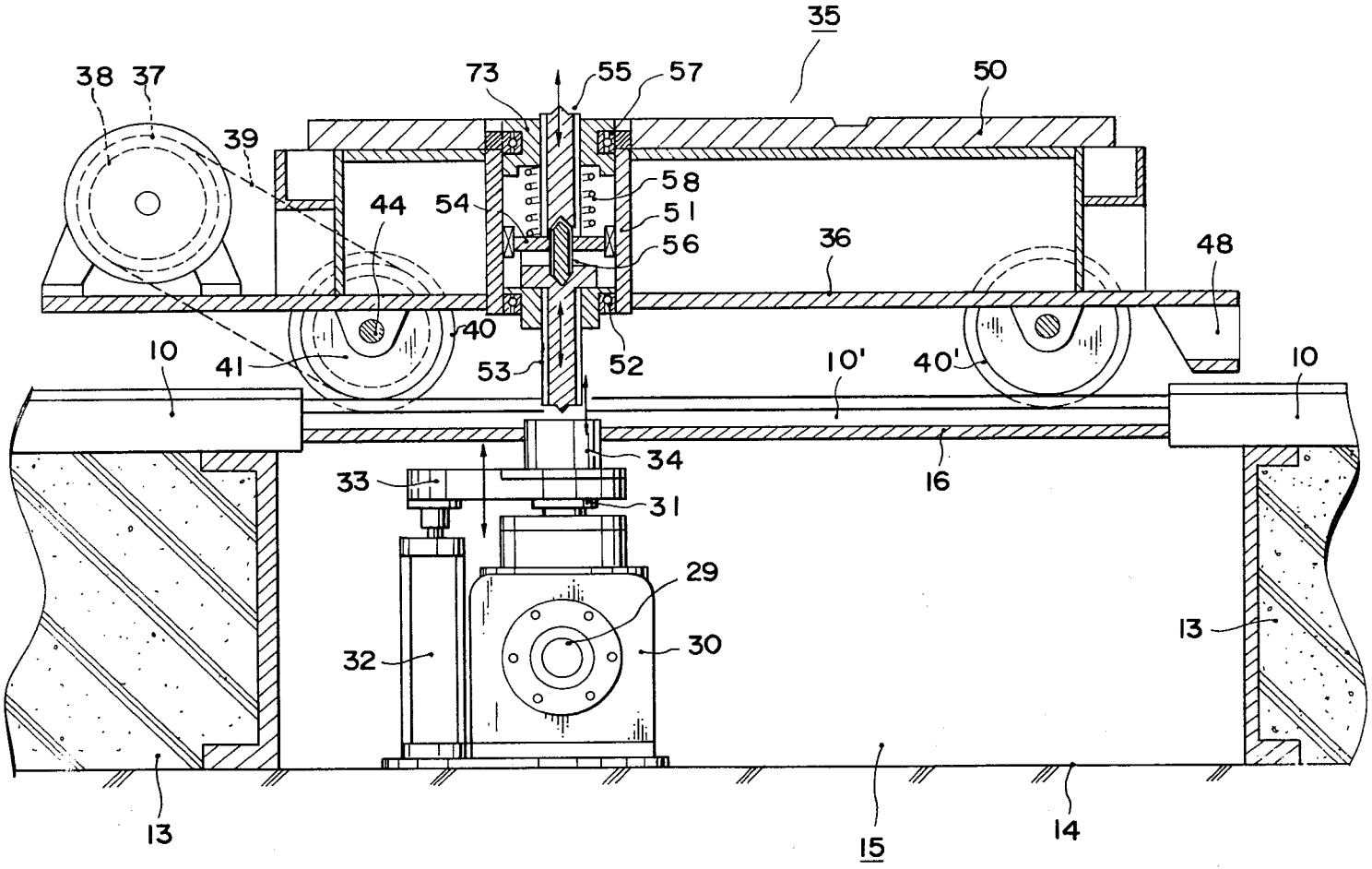
FIG. 5 is an elevational view illustrating the connection between the truck and the driving mechanism.
Figure 6:
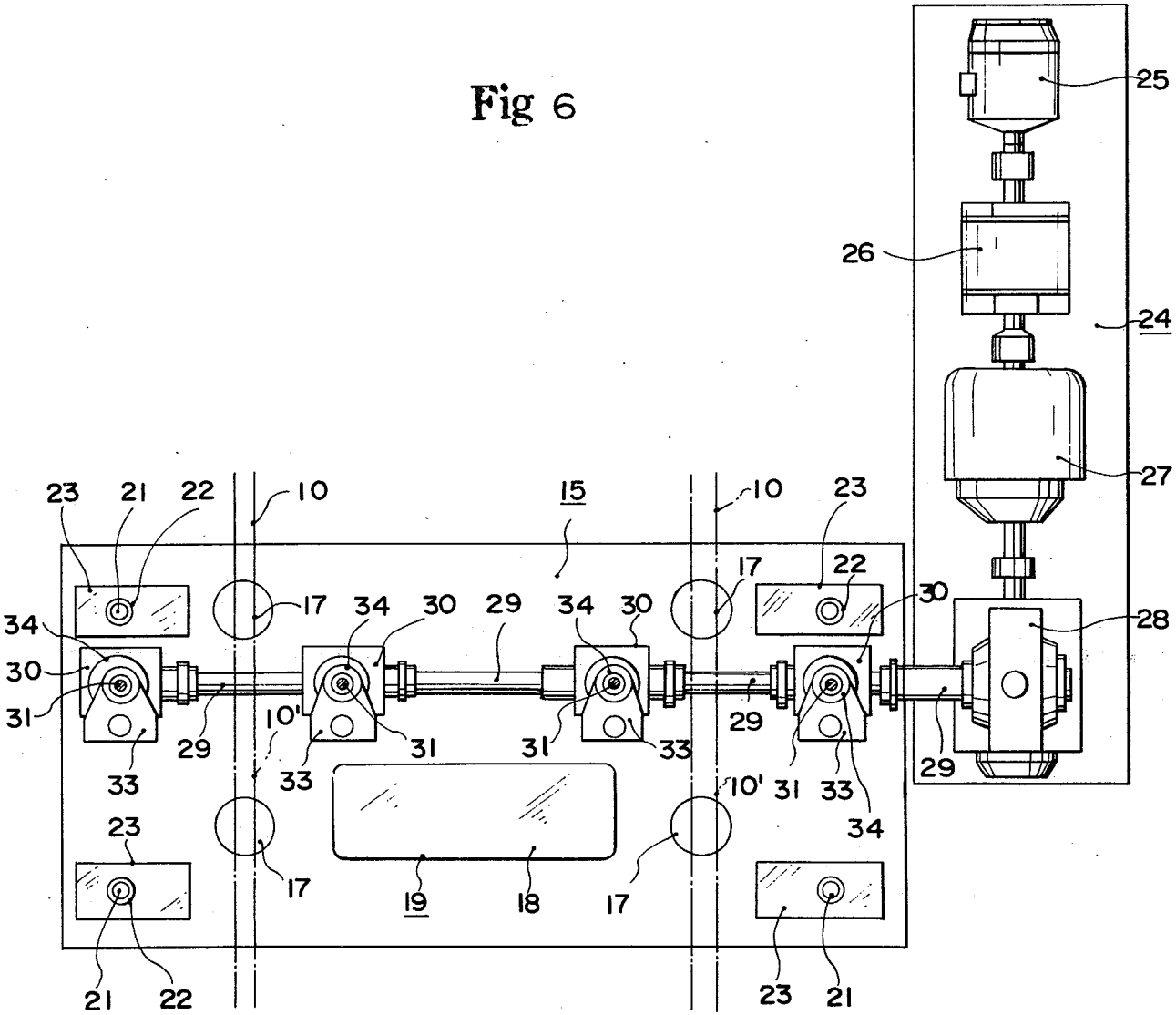
FIG. 6 is a plan view of the driving mechanism.

Referring to FIGS. 3, 4 and 5, the pair of rails 10 are laid on the bed 13 formed on the foundation 14. A portion of the bed 13 is evacuated to form a rolling process area 15, which is best illustrated in FIG. 6. A frame 16 is moved up or down, while maintaining its horizontal position, by operation of four hydraulic cylinders 17 installed on the foundation 14. The frame 16 has unit rails 10' installed thereon adjacent to the rails 10; the unit rails 10' are moved together with the frame 16.

Near the central portion of the rolling process area 15, columns 19, having a plate 18 on the top, are embedded in the foundation to form a fixing mechanism 20. At the four corners of the rolling process area 15 there are embedded in the foundation support, pillars 23 each having on its top a centering bracket 22 with a reverse-conical centering hole 21 formed on the upper side thereof. For the sake of simplicity, FIG. 3 illustrates only one column 19 and in FIG. 5 no columns are shown.

In FIGS. 5 and 6, disposed beside the rolling process area 15 is a driving unit 24 which consists of a motor 25, a clutch brake 26, a variable transmission 27 and a worm reduction gear 28, all these being connected in series. A rotating shaft 29 extends sideward from the worm reduction gear 28 into the rolling process area 15 where it is inserted into, and supported by, gearboxes 30 installed on the foundation.

Connected with the rotating shaft 29 through the bevel gear mechanisms, of known construction, installed in the gearboxes 30 are male-splines 31 which extend upward. At the front portion of the brackets 33, extending sideward from the upper end of the hydraulic cylinders 32 and disposed beside the respective gearboxes 30, female-splines 34 are sleeved over the male-splines 31 with ball bearings (not shown) interposed therebetween in such a way as to be vertically slidable along the male-splines 31.

Referring to FIGS. 3, 4 and 5, denoted by the numeral 35 is a movable truck, in which a motor 37 is mounted on the front portion of the lower frame 36 to drive a drive wheel 40 through a chain 39 engaging with the sprocket 38 of the motor 37 and the sprocket 41 of the drive wheel 40. The truck 35 can be moved to the desired position by operation of the motor with the drive wheel 41 and the follower wheel 40' rotating on the rails 10 and the unit rails 10'. The motor 37, sprockets 38, 41, chain 39 and the wheel 40 constitute a moving mechanism.

The shafts 44 of the drive wheel 40 and the follower wheel 40' are rotatably supported on the brackets 42 of the lower frame 36 through bearings 43.

The lower frame 36 is formed on the underside with columns 46 each having a plate 45 on its lower end. These columns form a fixing mechanism 47 which bear against the opposed fixing mechanism 20 erected in the area 15.

Centering bushings 49 are mounted on the underside of the lower frame 36 of the movable truck 35, at the four corners, through the brackets 48 so that they project downwardly to be received in the respective centering holes 21 of the centering bracket 22 installed in the area 15. For the sake of simplicity, only one pair of columns of the fixing mechanisms are shown.

As shown in FIG. 5, a bushing 51 is extended through the lower frame 36 and the upper frame 50 of the movable truck 35 at a location such that the axis of the bushing 51 coincides with that of the female-spline 34 when the centering bushings 49 are received into the centering holes 21. Mounted in the lower portion of the bushing 51, through a bearing 52, is a male-spline 53 which is rotatable and vertically slidable but is prevented from sliding downward below a certain level. Mounted above the male-spline 53 is another male-spline 55 which is prevented from going downward below a predetermined level by a flange 54 and which is connected with the lower male-spline 53 through a joint spline 56 in such a manner that the upper male-spline 55 is not only rotatable but also vertically movable. The vertical movement is cushioned by spring 58 interposed between the upper bearing 57 and the flange 54. The male-splines 53, 55 constitute a connector.

Figure 7:
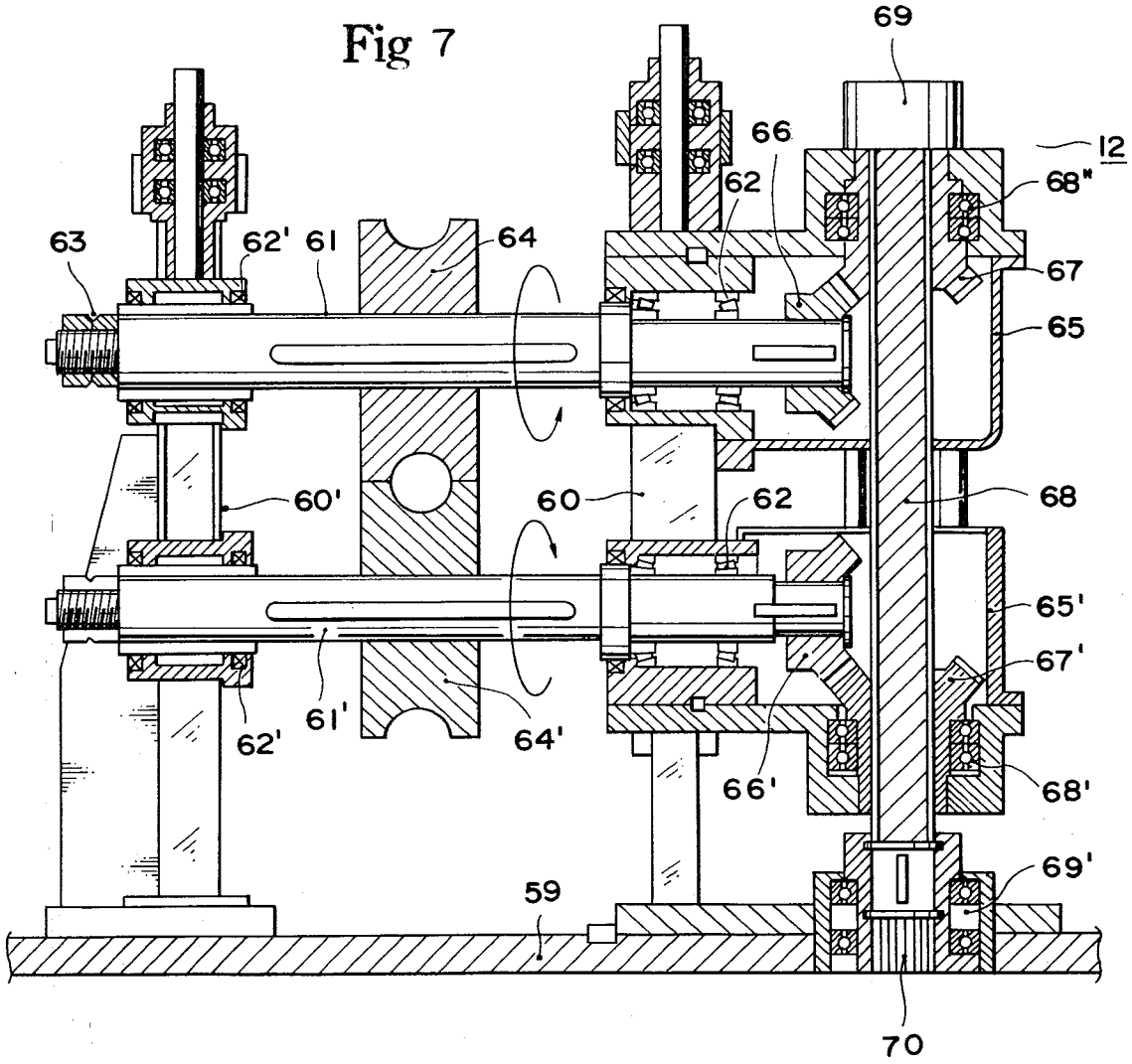
FIG. 7 is a partial cross-sectional view of the rolling mechanism.

FIG. 7 shows one unit of the rolling mechanism 12, the frame 59 of which is detachably mounted on the upper frame 50 of the truck 35. Provided on the frame 59 at predetermined locations are an inboard stand 60 and an outboard stand 60', each supporting upper and lower roll shafts 61, 61' through bearings 62, 62'.

Reference numeral 63 represents clamping nuts, and 64 and 64' designate rolls detachably mounted on the roll shafts 61, 61'. The nut 63 and the dismounting stand 60' constitute a roll-change mechanism.

L-shaped gear cases 65, 65' mounted on the fixed stand 60 have bevel gears 67, 67' rotatably mounted therein through bearings 68', 68'' and meshing at right angles with other bevel gears 66, 66' are fixed to the base of the roll shafts 61, 61'. The bevel gears 67, 67' are also fitted over the vertical drive shaft of the male-spline 68, the upper and lower ends of which are supported by cover mechanisms 69, 69' so that it is rotatable with respect to the gear cases 65, 65' and the frame 59 but not axially displaceable therefrom. The lower end of the spline 68 is formed into a female spline 70 for receiving the male-spline 55 of the connector.

In rolling the material, fed along the line 9, by the rolls 64, 64' of the tube forming mill having the above construction, the truck 35 is moved on the rails 10 to the predetermined position by means of the motor 37, sprockets 38, 41, chain 39 and the wheels 40, 40'. Then, the outboard stand 60' of the rolling mechanism 12 is removed and the rolls 64, 64' are rigidly mounted on the shafts 61, 61'.

It is also possible to assemble the rolls into the rolling mechanism beforehand and to use a crane to mount the assembled rolling mechanism on the frame 50 of the truck 35 located at the assemblying position.

Then, the truck 35 equipped with the rolling mechanism 12 is moved to the position on the material feeding line 9 by actuating the motor 37. The unit rails 10' are maintained flush with the rails 10 by the hydraulic cylinders 17, which are actuated by a limit switch. When the truck 35 comes to the position on the line 9 and abuts against the limit switch (not shown), the motor 37 is stopped thus bringing the truck 35 to a rest.

At the same time, the hydraulic cylinders 17 are lowered, causing the truck 35 to move down while maintaining its horizontal position, with the result that the centering bushings 49 are received into the corresponding centering holes 21 thus guiding the truck 35 to a correct position. When the truck 35 is fully lowered, the downwardly extending fixing mechanism 47 rests on the opposed fixing mechanism 20 of the rolling process area 15, fixing the truck on the working position on the line.

Then, the microswitch actuates the hydraulic cylinder 32 to lift the bracket 33 and the female-spline 34 along the male-spline 31 so as to engage the female-spline 34 with the lower male-spline 53 of the connector. As the hydraulic cylinder 32 is further extended, the male-spline 53 lifts, through the joint spline 56, the upper male-spline 55 which in turn is inserted into the female-spline 70 formed at the lower end of the male-spline 68, and function as a vertical drive shaft of the rolling mechanism 12. In this way the drive system is automatically connected to the rolling mechanism.

When the motor 25 is started, the output of the motor is transmitted, by way of the clutch brake 26, to a variable transmission 27 and worm reduction gear 28, and then to the rotating shaft 29 which rotates male-splines 31 through bevel gears in the bevel gearboxes 30. The rotating torque of the male-splines 31 is transmitted by way of the female-spline 34 and the male-splines 53, 55 of the connector to the male-spline 68 of the rolling mechanism 12, from which it is further conveyed, through the bevel gears 67, 67' 66, 66' to the roll shafts 61, 61' thereby rotating the rolls 64, 64' to form the strip (not shown) fed along the line 9.

While the rolling of the strip is performed by the rolls 64, 64', other rolls 64, 64' to be used for the next rolling process are installed, in a manner already mentioned, in a rolling mechanism 12 mounted on another truck 35 at the assemblying position on the rails 10. It is also possible to provide a series of rolling mechanisms on the rails 10.

When the last coil is passed between the rolls 64, 64', the motor 25 is stopped and the reverse process is followed. That is, the hydraulic cylinder 32 is compressed bringing the male-spline 55 of the connector out of engagement with the male-spline 68 of the rolling mechanism 12 to cut off the driving force. At the same time, the hydraulic cylinders 17 are extended to lift the unit rails 10' to the level of the rails 10, and then the motor 37 is started to move the truck 35, together with the rolling mechanism, to the opposite assemblying position where the rolls are changed or some correction is made on the rolls.

Then, another truck 35 equipped with the rolling mechanism 12, to be used in the next stage of rolling process, is advanced to the vacant unit rails 10' to perform the next stage of rolling process in a manner already described.

This invention is not limited to the above embodiment and a plurality of pairs of rails may be laid across the material feeding line 9 whereby a series of rolling mechanisms are successively advanced to the line 9 after the preceding rolling mechanisms complete their rolling processes.

As can be understood from in the foregoing description, the tube forming mill of this invention has a construction such that the rails are basically laid at right angles with respect to the material feeding line, so that the unit rails are moved up or down by the elevating mechanism through the frame and the unit rails are lowered to firmly fix the truck and therefore the rolling mechanism. This construction enables the rolls to be assembled into the rolling mechanism mounted on the truck, at any position other than that on the material feeding line. As a result, the replacement or assemblying of the rolls can be done accurately and efficiently. Moreover, since the truck is lowered to firmly fix the rolling mechanism, a stable rolling operation is assured.

Furthermore, since this device is not required to have any special means to fix it against various forces acting upon the device during the rolling process, the structure of the device becomes simple.

The rolling mechanism of this invention is also characterized by the following features in construction. The rolling mechanism, a kind of moving plant on the truck, does not have a driving mechanism but includes a vertical driving shaft which, when the rolling mechanism is positioned on the material feeding line, is connected through the connector with the driving mechanism disposed under the unit rails or the floor. This construction provides ample space on the floor, which in turn improves safety and efficiency in the assemblying work or the rolling mechanism.

In general, the rolling process is performed in several stages. With this invention, a series of rolling mechanisms can be successively advanced to the material feeding line after as the preceding rolling mechanisms complete their rolling processes. In this way, several stages of rolling process can be performed very effectively.

Furthermore, if the rolls and the rolling mechanism are replaced or assembled separately at different assemblying positions, mistakes in the assemblying or replacement works can be precluded.

What is claimed is:

1. A tube forming mill comprising: a means for changing rolls for the succeeding stages of a rolling process; rails directionally crossing a material feeding line at right angles thereto; unit rails provided at the crossing between the rails and the feeding line; an elevating mechanism disposed below the unit rails and acting upon the unit rails through a frame; a fixing mechanism arranged beside the elevating mechanism; a movable truck having a moving mechanism and adapted to travel on the rails; and a rolling mechanism mounted on the truck.

2. A tube forming mill as set forth in claim 1, wherein the elevating mechanism consists of four hydraulic cylinders disposed at the corners of the frame.

3. A tube forming mill as set forth in claim 1, wherein the fixing mechanism is a column having a plate on its top, said column being firmly erected on a foundation and adapted to bear against the plate of an opposed fixing mechanism, which is provided to the underside of a frame of the movable truck.

4. A tube forming mill as set forth in claim 1, wherein the moving mechanism is a motor.

5. A tube forming mill comprising: a means for changing rolls for the succeeding stages of a rolling process; rails directionally crossing a material feeding line at right angles thereto; unit rails provided at the crossing between the rails and the feeding line; an elevating mechanism disposed below the unit rails and acting upon the unit rails through a frame; a fixing mechanism arranged beside the elevating mechanism; a driving mechanism having a vertically movable connector disposed on its top; a movable truck, having a moving mechanism, and adapted to travel on the rails; a rolling mechanism mounted on the truck; and a vertical drive shaft provided for the rolling mechanism which shaft can be brought into and out of engagement with the connector.

6. A tube forming mill as set forth in claim 5, wherein the driving mechanism includes upwardly extending male- and female-splines, the female-spline being adapted to be brought into and out of engagement with the connector by operation of a hydraulic cylinder.

7. A tube forming mill as set forth in claim 5, wherein the vertical drive shaft of the rolling mechanism is splined and engageable with the spline of the connector.

* * * * *